US009890539B2

(12) United States Patent
Tuttle

(10) Patent No.: US 9,890,539 B2
(45) Date of Patent: Feb. 13, 2018

(54) WALL COVERING SYSTEM OF SELF-ADHERING WOOD PANELS

(76) Inventor: Michael T. Tuttle, Indianapolis, IN (US)

( * ) Notice: Subject to any disclaimer, the term of this patent is extended or adjusted under 35 U.S.C. 154(b) by 0 days.

(21) Appl. No.: 13/354,847

(22) Filed: Jan. 20, 2012

(65) Prior Publication Data

US 2013/0186029 A1 Jul. 25, 2013

(51) Int. Cl.
*E04F 13/08* (2006.01)
*E04F 13/10* (2006.01)

(52) U.S. Cl.
CPC ..... *E04F 13/0871* (2013.01); *E04F 13/0885* (2013.01); *E04F 13/10* (2013.01); *E04F 2203/02* (2013.01)

(58) Field of Classification Search
CPC . E04F 13/076; E04F 13/0889; E04F 13/0894; E04F 15/02038; E04F 2201/02; E04F 2201/022; E04F 2201/03
USPC ..... 52/311.1, 588.1, 311.2, 313, 518, 519, 52/554, 555, 557, 559
See application file for complete search history.

(56) References Cited

U.S. PATENT DOCUMENTS

| | | | | |
|---|---|---|---|---|
| 4,090,338 | A * | 5/1978 | Bourgade | 52/392 |
| 5,794,542 | A * | 8/1998 | Besaw | 108/51.3 |
| 6,601,359 | B2 * | 8/2003 | Olofsson | 52/588.1 |
| 8,356,447 | B2 * | 1/2013 | Lach | 52/177 |
| 2004/0221530 | A1 * | 11/2004 | Winberry | 52/311.1 |
| 2008/0295433 | A1 * | 12/2008 | Eyal et al. | 52/403.1 |
| 2009/0123692 | A1 * | 5/2009 | Kaump | 428/99 |
| 2009/0155612 | A1 * | 6/2009 | Pervan et al. | 428/498 |
| 2010/0043314 | A1 * | 2/2010 | Ruggie et al. | 52/105 |
| 2010/0300030 | A1 * | 12/2010 | Pervan et al. | 52/588.1 |
| 2011/0146188 | A1 * | 6/2011 | Wallin | 52/588.1 |
| 2013/0186029 | A1 * | 7/2013 | Tuttle | 52/588.1 |

* cited by examiner

*Primary Examiner* — Andrew J Triggs
(74) *Attorney, Agent, or Firm* — Maginot, Moore & Beck, LLP

(57) ABSTRACT

A wall panel system is provided that includes a series of interlocking wall panels with a pressure-adherent backing. The wall panels are configured to be placed on a wall in interlocking fashion, with the interlocking attributes contributing to the overall appearance of the panel. In one aspect, surface features are provided on the wood panels that add surface texture to the panel by laser burning into the surface of the wood panel. The width of the surface features can be changed by adjusting the properties of the laser, such as beam focus. The wood panels are conveniently sized so that they can be easily manipulated for interlocking placement on the wall.

11 Claims, 1 Drawing Sheet

WALL COVERING SYSTEM OF SELF-ADHERING WOOD PANELS

BACKGROUND

The present disclosure relates to wall coverings, and more particularly to wood panels for mounting on walls.

Traditional wall paneling often consists of ¼-½ in. thickness wood panels that are nailed and/or glued to the wall. Both approaches are time consuming, and in the case of gluing somewhat painstaking. The gluing process requires additional preparation for applying the glue layer to the back of the wood panel, and applying an amount of glue that is sufficient to hold the wood panel firmly and flatly against the existing wall. Moreover, the typical wall panel, is cut to the height of the wall, making it cumbersome to manipulate and hold in place as the panel is being mounted to the wall.

Flexible wall coverings, such as wall paper, are also painstaking and cumbersome to apply. Moreover, the typical flexible covering lacks the surface texturing that can be achieved with the traditional wall panel. There is a need for a textured wood wall covering that is versatile and easy to mount to a wall.

SUMMARY

A wall panel system is provided that includes a series of interlocking wall panels with a pressure-adherent backing. The wall panels are configured to be placed on a wall in interlocking fashion, with the interlocking attributes contributing to the overall appearance of the panel. In one aspect, the wall panels are about 1/16 in thick and are flexible to facilitate mounting to the wall. The back side of the panels is provided with a self-adherent or pressure-adherent composition initially covered by a backing sheet. The sheet can be readily removed for placement of the individual panel.

In a further aspect, surface features are provided on the wood panels that add surface texture to the panel. The features are formed by laser burning into the surface of the wood panel. The width of the surface features can be changed by adjusting the properties of the laser, such as beam focus.

The wood panels are conveniently sized so that they can be easily manipulated for interlocking placement on the wall. Thus, in one embodiment the panels are provided at a width of 12-15 in. and a length of 18-24 in.

DETAILED DESCRIPTION

Figure 2:
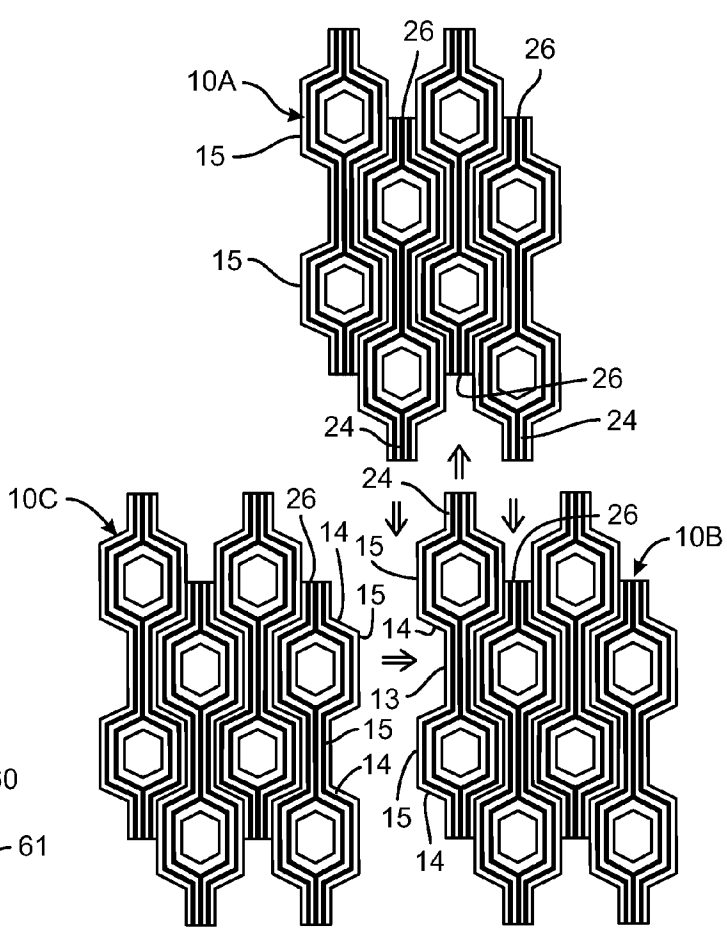
FIG. 2 is a plan view of an arrangement of wall panels, such as the panel shown in FIG. 1, illustrating the interlocking nature of the panels.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 1:
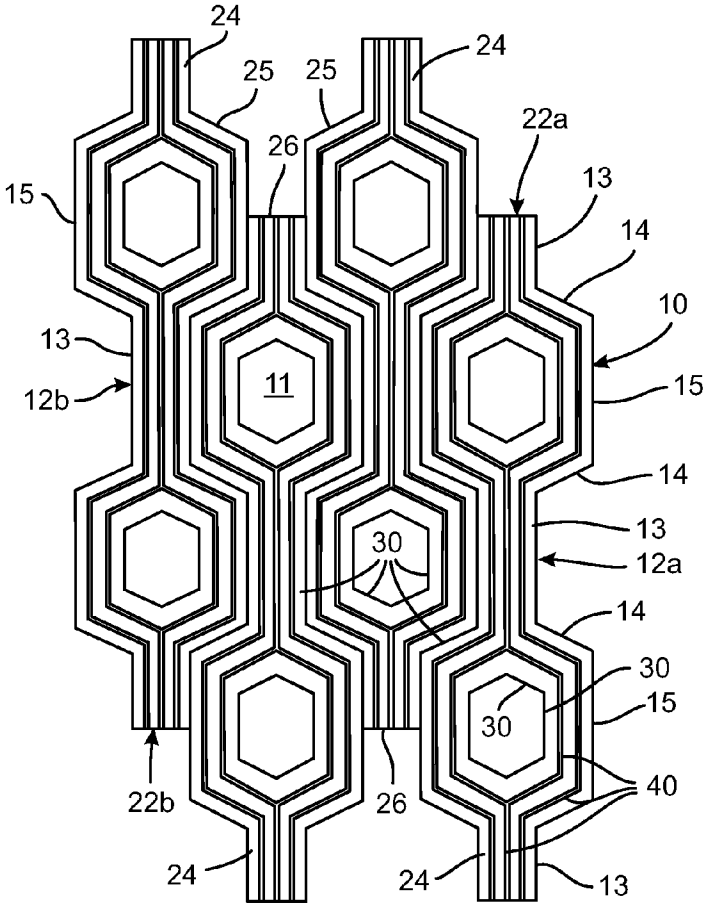
FIG. 1 is a plan view of a wall panel according to one embodiment disclosed herein.

A wood panel 10 according to one embodiment is illustrated in FIG. 1. The panel is preferably formed of a wood material that is durable enough to withstand use on a building wall, yet light weight enough to be easily installed by a non-professional. Moreover, the wood must be capable of formation into very thin sheets, on the order of 1/16 in. or less in thickness. Suitable woods include woods used for veneer, such as birch, cherry, chestnut, mahogany, maple, oak, pine, teak and walnut. The panel is thin enough to exhibit limited flexibility that simplifies mounting the panel on a wall, as described herein.

Figure 3:
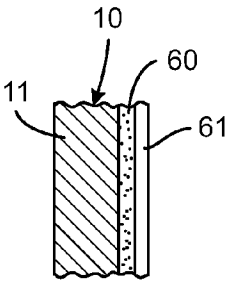
FIG. 3 is an enlarged cross-sectional view of the wall panel shown in FIG. 1.

The front or exposed surface 11 of the panel 10 is decorative and incorporates a pattern formed in the surface, as described in more detail herein. The back surface of the panel includes a layer 60 of a self- or pressure-adhering material covered by a removable backing sheet 61, as shown in FIG. 3. The layer 60 is formed of an adhesive that readily bonds to the wood when the layer is applied during production of the panel. The adhesive is also capable of rapidly bonding to a variety of surfaces, such as conventional wall board or gypsum. The layer 60 and backing sheet 61 are very thin, such as less than 1/64 in. In certain embodiments the layer 60 may be an acrylic film, a rubber-based adhesive, or a styrene copolymer material (such as SBS or SIS), or other suitable adhesive that exhibits high tack strength and pressure adhering capabilities.

In one aspect, the panel 10 is formed for interlocking with other like-configured panels to complete a wall installation. Thus, the panel 10 is not sized to fill the entire height of a wall, like traditional wall paneling, but rather provided in discretely sized panels that can be easily manipulated by the installer without the need for tools. In one embodiment the panels have an overall width of 12-15 in. and an overall length of 18-24 in. The panel 10 can thus be easily held by the installer and applied to the wall surface. As shown in FIG. 1, the perimeter of the panel incorporates interlocking features that permit interlocking layout of panels at all sides of the panel. In one embodiment, the opposite sides 12*a*, 12*b* each include a recess 13 bounded by angled edges 14 leading to a projection in the form of plateau edge 15. In the illustrated embodiment, one recess 13 is flanked by two plateaus 15 and partial recesses are provided at the ends of the sides 12*a*, 12*b* that include only one angled edge. However it is understood that the inverse of this arrangement can be used. As shown in FIG. 1, the recess and plateaus are offset between side 12*a* and side 12*b*. In other words, the recesses and plateaus on side 12*a* are offset in a first vertical direction from the recesses and plateaus on side 12*b*.

The ends 22*a*, 22*b* include a recess 26, angled edges 25 and projections 24, with the projections being complementary configured to be received within the recess 26. Like the sides, the ends include one full recess, two partial recesses and two projections, although the inverse arrangement can be implemented. Also like the sides, the ends 22*a*, 22*b* are configured with the recess and projections offset from end to end. In other words, the recesses and plateaus on end 22*a* are offset in a second horizontal direction from the recesses and plateaus on end 22*b*. This offset and complementary feature allows multiple panels to be interlocked when placed on a wall, as illustrated in FIG. 2.

Redecorating a wall with the wall panels 10 disclosed herein can proceed in a manner similar to laying floor tile. In particular, an arrangement of vertical and horizontal lines may be drawn on the wall to be used as a reference to ensure square placement of each panel. The panel 10A may be mounted first to the wall by removing the backing sheet 61 (FIG. 3) to expose the pressure-adhesive layer 60. The panel is positioned on the wall in the desired orientation, such as by aligning the plateau edges 15 with a vertical plumb line previously drawn on the wall. The recesses 26 in one end edge may also be aligned with a perpendicular horizontal line. The next panel 10B may be added below the first panel 10A by removing the backing sheet for panel 10B and sliding the panel upward so that the projections 24 are seated within a corresponding recess 26. It can be appreciated that each successive panel that is added below the first two panels 10A, 10B will also shift the panel assembly laterally.

As shown in FIG. 2, a third panel 10C may be added by sliding the panel sideways so that the recesses 13 and plateaus 15 interlock with the angled edges 14 contacting each other. It can be appreciated that the partial recess 26 on panel 10C becomes bounded on its open side by the plateau 15 of the other panel 10B, with the projection 24 at the left side of the panel 10A disposed in that space. Much like tiling a floor, additional panels 10 are added in the same manner with periodic checks of the relationship of the sides and ends of the panels relative to various plumb lines drawn on the wall to ensure that the panels are being mounted squarely with the wall. When the array of installed panels reaches the ceiling, floor or side walls it is apparent that a panel will need to be cut to size. Since the panels 10 are formed of wood the cut can be easily and accurately made with a circular saw or other woodworking tools.

In another attribute of the panel 10, the interlocking features at sides 12*a*, 12*b* and ends 22*a*, 22*b* reflect the design defined in the surface 11 of the panel. Thus, when multiple panels are interlocked, as shown in FIG. 2, the interlocking edges carry the surface design uninterrupted throughout the panels. The end result is a seamless, continuous pattern across the entire wall.

The interlocking features and the surface pattern are generated using a laser. A number of panels 10 are formed from a single sheet of wood by varying the beam width and intensity of the laser beam. (The wood sheet is provided with the pressure adhesive layer 60 and backing sheet 61 prior to operating the laser). The design on surface 11 shown in FIG. 1 includes a pattern of narrow lines 30 that are generated with a narrow beam focus at a first energy level that is only sufficient to cut a shallow groove in the panel surface 11. The laser can be computer controlled to create the pattern of narrow lines across the entire wood sheet, encompassing several eventual individual panels 10. The surface pattern may include more pronounced surface features 40 that are formed by defocusing the laser beam to create a wider beam at the first intensity. The laser is moved throughout the entire wood sheet to form the pattern of features 40, again encompassing several eventual individual sheets. The laser is maintained at the first intensity, or may be increased to a greater second intensity that is only sufficient to cut a shallow groove along the lines 40. The greater beam intensity may be required because the beam is less focused than when forming the first thinner lines 30. In addition, a greater intensity can make the lines 40 deeper into the surface 11 to create a more pronounced three-dimensional effect. With both lines 30 and 40 it is important that the laser beam be insufficient to burn completely through the wood sheet and preferably insufficient to burn more than a nominal depth that might otherwise compromise the integrity of the eventual panel. Alternatively, certain of the lines may be burnt to a depth that can act as a separation point to remove a portion of a panel.

With respect to the wider lines 40 the use of a laser produces a very visible pattern by burning the wood as the lines are formed. This is in contrast to forming the lines using a router that simply cuts or removes wood material. In the case of router-cut grooves or lines, the wood surface must be further treated to accentuate the grooves, such as by staining. On the other hand, with the panels 10 disclosed herein, the process of forming the lines/grooves also "treats" the wood surface to accentuate the design features. No further processing or treatment is required.

The sides 12*a*, 12*b* and ends 22*a*, 22*b* are then cut using a narrow focus beam at a higher third intensity that is sufficient to cut entirely through the wood sheet. This third pass of the laser beam separates the wood sheet into the individual panels 10.

It can be appreciated that the irregular perimeter of the panel 10 will necessarily result in partial panels at the edges of the original wood sheet. These partial panels will be bounded by one linear edge for partial panels cut within the interior of the wood sheet, or by two linear edges for partial panels at the corner of the wood sheet. These partial panels may be recycled, or may be provided for corner and end pieces in a wall covering. The laser may thus be controlled so that the various burns for lines 30, 40, 12*a*, 12*b*, 22*a*, 22*b* orient the linear edges with the recesses 13 and 26. The partial panels may serve as the starting point for application of the panels onto a wall.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected. For instance, types of wood identified above, or the dimensions of the panels described herein may be modified depending upon application or desirability. In addition, while the pattern and features defined in the wood panels are disclosed as being formed by a laser, other methods for controllably burning the wood are contemplated.

What is claimed is:

1. A wall covering system for a building wall comprising:

a plurality of like-configured interlocking wood panels, each of said wood panels including;

a rear surface for engagement with a building wall surface and an opposite exposed front surface;

a perimeter shape defined in a plan view of the front surface of the panels, the perimeter shape having opposite sides and opposite ends in said plan view;

a first arrangement of one or more recesses and one or more projections formed in one of said opposite sides of the perimeter shape, and a second arrangement of one or more recesses and one or more projections formed in the other of said opposite sides of the perimeter shape, said first and second arrangements configured so that said one or more projections on said one of said opposite sides of one of said plurality of wood panels interlock with said one or more recesses on said other of said opposite sides of an adjacent wood panel and so that said one or more recesses on said one of said opposite sides of one of said plurality of wood panels interlock with said one or more projections on said other of said opposite sides of an adjacent wood panel;

a third arrangement of one or more recesses and one or more projections formed in said one of said opposite ends of the perimeter shape, and a fourth arrangement of one or more recesses and one or more projections formed in said other of said opposite ends of the perimeter shape, said third and fourth arrangements configured so that said one or more projections on said one of said opposite ends of said one of said plurality of wood panels interlock with said one or more recesses on said other of said opposite ends of an adjacent wood panel, and so that said one or more recesses on said one of said opposite ends of one of said plurality of wood panels interlock with said one or more projections on said other of said opposite ends of an adjacent wood panel; and a pattern of lines defined at a depth across said front surface of said wood panel, said pattern of lines cooperating with said first, second, third and fourth arrangements of one or more recesses and one or more projections to form a continuous, uninterrupted pattern across the building wall surface when said plurality of wood panels is mounted to the building wall, the continuous, uninterrupted pattern including the first, second, third and fourth arrangements of said one or more recesses and said one or more projections.

2. The wall covering system of claim 1, wherein said pattern of lines is formed by burning the wood.

3. The wall covering system of claim 2, wherein the pattern of lines is formed by a computer controlled laser.

4. The wall covering system of claim 3, wherein said pattern of lines includes a first pattern of lines and a second pattern of lines that are wider than said lines in said first pattern.

5. The wall covering system of claim 4, wherein said second pattern of lines are formed by applying a laser beam having a width greater than the width of the laser beam used to produce the first pattern of lines.

6. The wall covering system of claim 1, wherein said first arrangement of one or more recesses and one or more projections includes one or more recesses and one or more projections formed by the perimeter shape of said one of said sides that are offset in a first direction along said one of said sides from said one or more recesses and said one or more projections of said second arrangement formed by the perimeter shape of said other of said sides.

7. The wall covering system of claim 6, wherein said third arrangement of one or more recesses and one or more projections includes one or more recesses and one or more projections formed by the perimeter shape of said one of said ends that are offset in a second direction along said one of said ends, perpendicular to said first direction, from said one or more recesses and said one or more projections of said fourth arrangement formed by the perimeter shape of said other of said ends.

8. The wall covering system of claim 1, wherein each wood panel includes a self-adhesive layer on the rear surface of said wood panel, said self-adhesive layer including a backing sheet removably covering said layer.

9. The wall covering system of claim 1, wherein each of said wood panels has a maximum width of about 12-15 in. and a maximum length of about 18-24 in.

10. The wall covering system of claim 1, wherein each of said wood panels has a thickness of about 1/16 in.

11. The wall covering system of claim 1, wherein said rear surface of said wood panel includes a self- or pressure-adhering layer adapted for self-adhering to the building wall surface.

* * * * *